US006318972B1

(12) United States Patent
Huang et al.

(10) Patent No.: US 6,318,972 B1
(45) Date of Patent: Nov. 20, 2001

(54) VALVE RECESS IN CYLINDER BLOCK OF A COMPRESSOR

(75) Inventors: Yong Huang, Ann Arbor; Laviesh Sud; Shane Harte, both of Farmington Hills, all of MI (US)

(73) Assignees: Ford Motor Technologies, Inc.; Visteon Global Technologies, Inc., both of Dearborn, MI (US)

( * ) Notice: Subject to any disclaimer, the term of this patent is extended or adjusted under 35 U.S.C. 154(b) by 0 days.

(21) Appl. No.: 09/538,190

(22) Filed: Mar. 30, 2000

(51) Int. Cl.[7] ..... F04B 1/12
(52) U.S. Cl. ..... 417/269; 137/856
(58) Field of Search ..... 417/269, 270, 417/255, 312; 137/856; 62/217

(56) References Cited

U.S. PATENT DOCUMENTS

| | | | | |
|---|---|---|---|---|
| 4,011,029 | * | 3/1977 | Shimizu | 417/269 |
| 4,283,166 | * | 8/1981 | Hiraga | 417/269 |
| 4,330,999 | * | 5/1982 | Nakayama | 62/217 |
| 4,730,987 | * | 3/1988 | Kawai et al. | 417/270 |
| 4,749,340 | * | 6/1988 | Ikeda et al. | 417/269 |
| 4,867,650 | * | 9/1989 | Ikeda et al. | 417/269 |
| 4,886,424 | * | 12/1989 | Ikeda et al. | 417/269 |
| 5,171,137 | * | 12/1992 | Todescat et al. | 417/571 |
| 5,562,425 | * | 10/1996 | Kimura et al. | 417/269 |
| 5,603,611 | * | 2/1997 | Tarutani et al. | 417/269 |
| 5,613,837 | * | 3/1997 | Konishi et al. | 417/255 |
| 5,722,818 | * | 3/1998 | Ohta et al. | 417/312 |
| 5,795,139 | | 8/1998 | Ikeda et al. . | |
| 5,839,472 | * | 11/1998 | Shintoku et al. | 137/856 |

* cited by examiner

*Primary Examiner*—Teresa Walberg
*Assistant Examiner*—Leonid M Fastovsky

(57) ABSTRACT

A compressor (10) for a vehicular air conditioning system includes a cylinder block (12) having a bore (14). A piston (78) is slidingly received in the bore (14). A cylinder head (16) is mounted on the cylinder block (12) and includes a suction chamber (20) and a discharge chamber (22). A valve plate (18) is provided between cylinder block (12) and the cylinder head (16). The valve plate (18) includes a suction port (26) and a discharge port (35). A suction valve (28) cooperates with the suction port (26) to permit refrigerant to enter the bore (14) from the suction chamber (20). The suction valve (28) includes a terminating portion (28A) and a flexing portion (28B). A recess (32) is formed in the cylinder block (12) adjacent the flexing portion (28B) of the suction valve (28). The recess (32) provides a linear clamping line (C) on the suction valve (28) between the valve plate (18) and the cylinder block (12).

14 Claims, 2 Drawing Sheets

VALVE RECESS IN CYLINDER BLOCK OF A COMPRESSOR

BACKGROUND OF THE INVENTION

This invention relates in general to vehicular air-conditioning systems. In particular, this invention is concerned with a recess for a suction valve in a compressor of a vehicular air conditioning system.

Air-conditioning systems are provided in vehicles for maintaining interior air at desired temperatures. Conventional vehicular systems include a compressor, a condenser, an expansion valve (or orifice tube), and an evaporator. A refrigerant is repeatedly circulated through the cycle of compressor, condenser, expansion valve, and evaporator to maintain interior air at desired temperatures.

A typical refrigerant cycle operates in the following manner. A refrigerant is first compressed by a compressor to a high temperature and high pressure gas and then directed to a condenser. In the condenser, the gas is changed to a lower temperature, high pressure liquid as it is cooled by a heat exchanger operating with the surrounding atmosphere or cooling water. The high pressure liquid loses pressure and becomes chilled when it passes through an expansion valve. When the low pressure liquid passes through an evaporator, it evaporates as it absorbs ambient heat. The evaporated refrigerant, i.e. a gas, flows into the compressor and the process is repeated.

A typical compressor includes a suction chamber and a discharge chamber. A valve is provided at a suction port between the suction chamber and a bore of a cylinder block for a piston in the compressor. The valve, commonly known as a suction valve, is commonly formed by a reed valve.

The suction valve flexes or bends as it opens to permit refrigerant to pass into a bore of the cylinder block. The suction valve is subjected to stresses as it bends and encounters the lip of the bore.

SUMMARY OF THE INVENTION

The present invention includes a compressor of a vehicular air conditioning system. The compressor includes a valve recess in a cylinder block to accommodate the bending of a suction valve. As refrigerant passes into a bore in a cylinder block, a linear wall of the recess reduces the stresses incurred by the suction valve. The reduced stresses improve the life of the suction valve.

In a preferred embodiment, a compressor for a vehicular air conditioning system includes a cylinder block having a bore. A piston is slidingly received in the bore. A cylinder head is mounted on the cylinder block and includes a suction chamber and a discharge chamber. A valve plate is provided between cylinder block and cylinder head. The valve plate includes a suction port and a discharge port. A suction valve cooperates with the suction port to permit refrigerant to enter the bore from the suction chamber. The suction valve includes a terminating portion and a flexing portion. A recess is formed in the cylinder block adjacent the flexing portion of the suction valve. The recess provides a linear clamping line on the suction valve between the valve plate and the cylinder block.

Various objects and advantages of this invention will become apparent to those skilled in the art from the following detailed description of the preferred embodiment, when read in light of the accompanying drawings.

DETAILED DESCRIPTION

Figure 1:
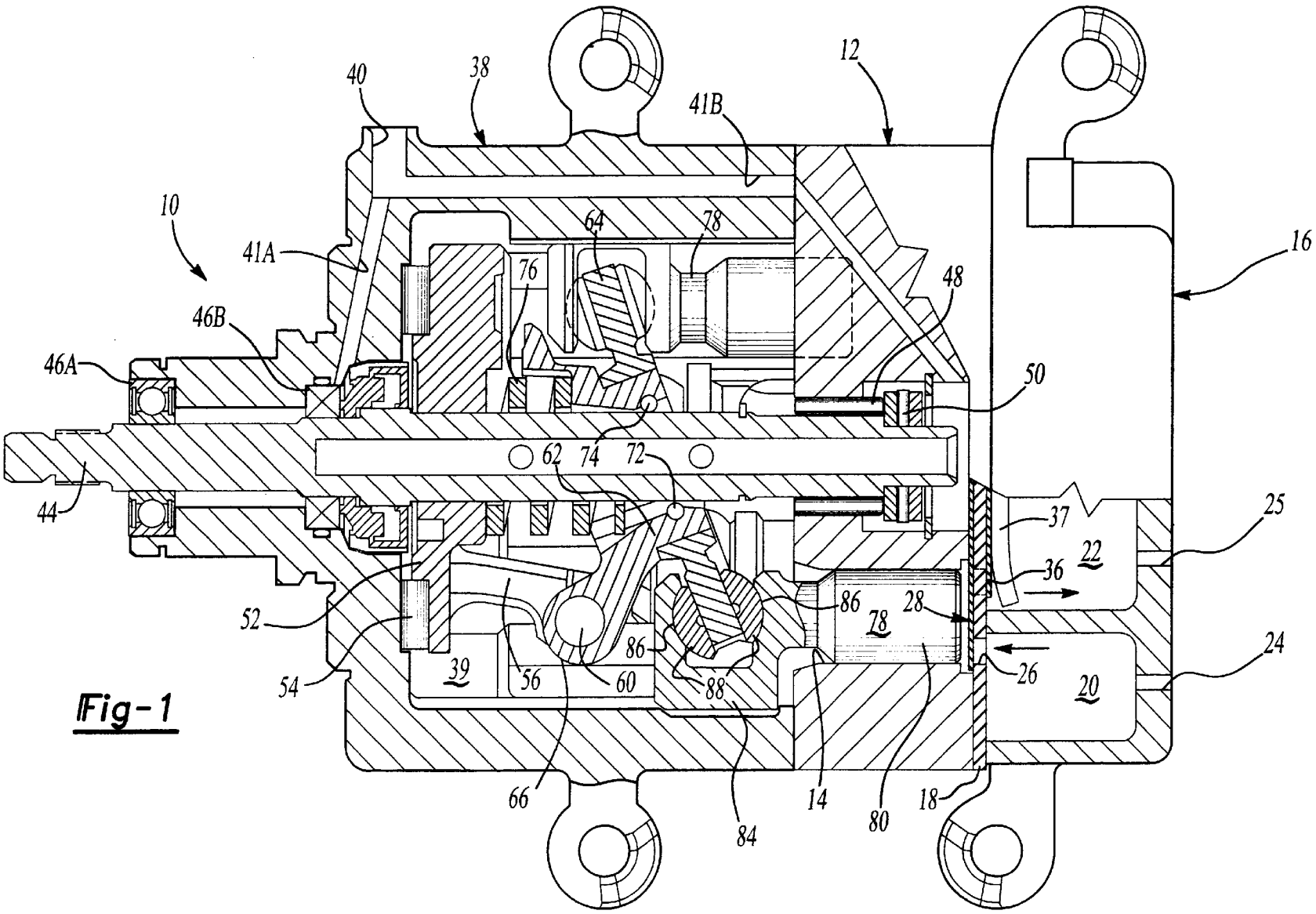
FIG. 1 is a partly sectional view of a compressor for a vehicular air-conditioning system according to this invention wherein a suction valve is shown in the closed position.

A compressor is indicated generally at 10 in FIG. 1. The compressor 10 is particularly adapted for a vehicular air conditioning system. The compressor 10 can be used with a refrigerant such as carbon dioxide. The compressor 10 discharges compressed refrigerant to a vehicular air condition system that can include a condenser, an expansion valve, and an evaporator, none of which are illustrated.

At its mid portion, the compressor 10 includes a cylinder block 12 having a plurality of bores 14. The cylinder block 12 is preferably formed as a housing. A cylinder head 16 is mounted on and sealingly closes one end of the cylinder block 12. A valve plate 18 is disposed between the cylinder block 12 and the cylinder head 16.

The cylinder head 16 includes a suction chamber 20 and a discharge chamber 22. The suction chamber 20 has an inlet port 24 formed in the cylinder head 16. The discharge chamber has an outlet port 25 formed in the cylinder head 16.

The suction chamber 20 communicates with each of the bores 14 through a respective suction port 26 formed in the valve plate 18. Each of the suction ports 26 is opened and closed by a suction valve 28. As illustrated best in FIG. 2, the suction valve 28 is a thin, flexible member, preferably formed by a reed valve. The suction valve 28 flexes away from the suction port 26 as refrigerant is received into the bore 14.

Figure 2:
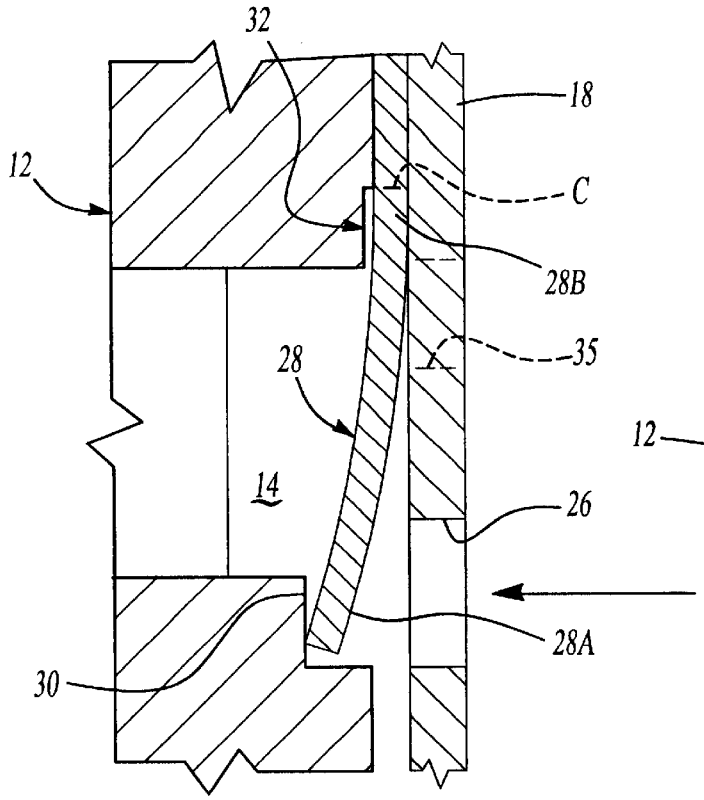
FIG. 2 is an enlarged view of a portion of the compressor of FIG. 1 wherein the suction valve is shown in the open position.
Figure 4:
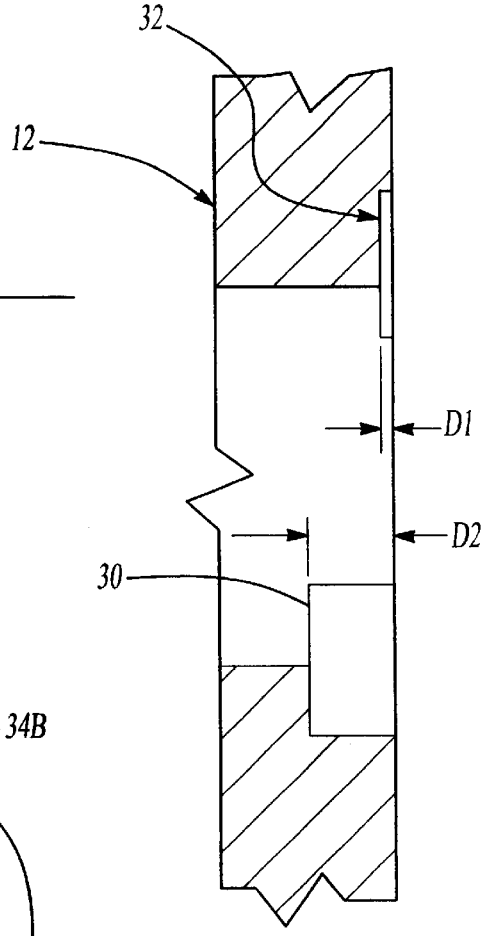
FIG. 4 is a sectional view taken along line 4—4 of FIG. 3 with the suction valve removed.
Figure 3:
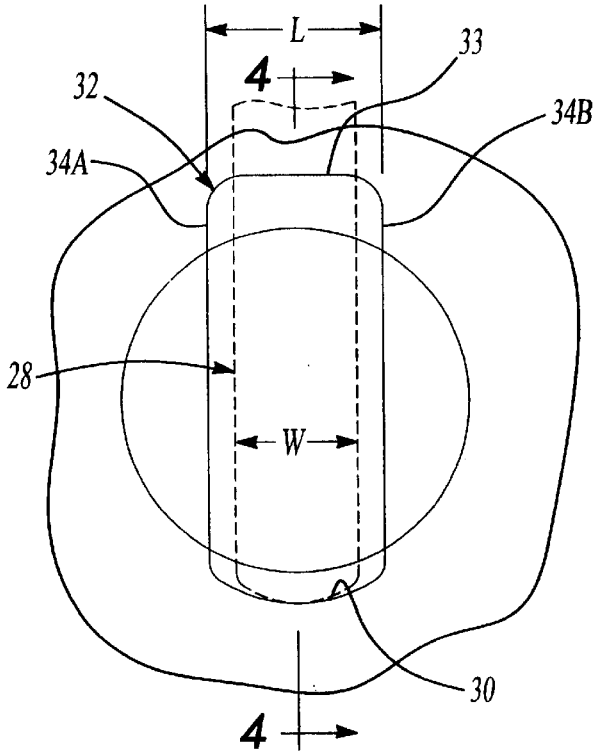
FIG. 3 is an end view of a portion of the cylinder block of the compressor of FIGS. 1 and 2 and illustrating the suction valve in phantom.

As illustrated in FIGS. 2, 3 and 4, a step 30 is provided about a portion of a perimeter of the bore 14 in a face of the cylinder block 12. The step 30 is positioned adjacent a terminating end 28A of the suction valve 28. The step 30 acts as a stop or limiter for the terminating end 28A of the suction valve 28 when the suction valve 28 is opened. The step 30 has a sufficient depth to permit the suction valve 28 to open and permit flow into the bore 14.

A recess 32 is provided about a portion of a perimeter of the bore 14 in the face of the cylinder block 12. The recess 32 is formed opposite the step 30. The recess 32 is positioned adjacent a flexing portion 28B of the suction valve 28. Preferably, the recess 32 includes a linear or straight wall 33 spaced from an inner cylinder surface and perimeter of the bore 14. The recess 32 also includes side walls 34A and 34B that are preferably perpendicular to the linear wall 33 and parallel to one another. Preferably, the linear wall 33 has a length L greater than a width W of the flexing portion 28B of the suction valve 28. Preferably, the side walls 34A and 34B do not contact or interfere with the flexing of the suction valve 28. The linear wall 33 and the side walls 34A and 34B form three boundaries of the recess 32. The lip of the bore 14 forms A fourth boundary.

When the suction valve 28 opens, the termination portion 28A is received against the step 30. The flexing portion 28B bends and flexes along linear wall 33 of the recess 32. A linear or straight clamping line C is formed on the suction valve 28 where the valve plate 18 presses along the linear wall 33. The flexing portion 28B is subjected to less stress along the linear clamping line C than prior art suction valves that were subject to an arcuate clamping line formed along an portion of the perimeter of a bore. Reducing the stress in the flexing portion 28B increases the life of the suction valve 28 and improves its performance as compared to prior art suction valves.

As illustrated in FIG. 4, a depth D1 of the recess 32 is preferably less than a depth D2 of the step 30. The depth D1 can be sized to permit a longer bending radius of the suction valve 28. The length of the suction valve 28 (limited by the diameter of the bore 14) to valve lift ratio can be limited by material strengths. Increasing the bending radius with recess 32 can be accomplished without affecting the performance of the compressor 10. Preferably, the depth D1 of the recess 32 and the spacing of the linear wall 33 from the perimeter of the bore 14 are sized so that the flexed suction valve 28 does not contact the arcuate lip or perimeter of the bore 14.

Each of the bores 14 communicates with the discharge chamber 22 through a respective discharge port 35 formed in the valve plate 18. The discharge port 35 is circumferentially spaced from the suction port 26 and is schematically illustrated in dashed lines in the figures. Each discharge port 35 is opened and closed by a discharge valve 36. A retainer 37 restricts the opening of the discharge valve 36.

A crankcase 38 is sealingly disposed at the other end of the cylinder block 12 opposite the cylinder head 16. The crankcase 38 and cylinder block 12 cooperate to form an airtight crank chamber 39. An inlet port 40 is provided to the crank chamber 39. Refrigerant and oil are routed to the crank chamber 38 via conduits 41A and 41B.

A drive shaft 44 is centrally disposed within and arranged to extend through the crankcase 38. One end of the drive shaft 44 is rotatably supported by bearings 46A and 46B mounted in the crankcase 38 and the opposite end is rotatably supported in a bearing 48 mounted in the cylinder block 12. Longitudinal movement of the drive shaft 44 is restricted by a thrust bearing 50 mounted in the cylinder block 12.

A rotor 52 is fixedly mounted on an outer surface of the drive shaft 44 adjacent within the crank chamber 39. A thrust bearing 54 is mounted on an inner wall of the crankcase 38 in the crank chamber 39 and disposed between the crankcase 38 and the rotor 52. The thrust bearing 54 provides a bearing surface for the rotor 52. An arm 56 extends laterally from a surface of the rotor 52. A pin 60 has one end slidingly disposed in the arm 56 of the rotor 52.

A swash plate assembly includes a hub 62 and an annular plate 64. The hub 62 includes an arm 66 that extends outwardly and laterally from the surface of the hub 62. One end of the pin 60 is slidingly disposed in the arm 56 of the rotor 52, while the other end of the pin 60 is fixedly disposed in the arm 66 of the hub 62.

Two pins 72 and 74 are disposed in the hub 62 diametrically opposed to one another with a portion of the outer surface of the pins 72 and 74 exposed in a central opening of the hub 62.

The annular plate 64 has a centrally disposed opening adapted to receive the hub 62. The drive shaft 44 is slidably received within the opening formed in the hub 62 of the swash plate assembly.

A spring 76 is disposed to extend around the outer surface of the drive shaft 44. One end of the spring 76 abuts the rotor 52. The opposite end of the spring 76 abuts the hub 62 of the swash plate assembly.

A piston 78 is slidably disposed in each of the bores 14 in the cylinder block 12. Each piston 78 includes a head 80 and a bridge portion 84. A pair of concave shoe pockets 86 is formed in the bridge portion 84 of each piston 78 for rotatably supporting a pair of semi-spherical shoes 88. The spherical surfaces of the shoes 88 are disposed in the shoe pockets 86 with a flat bearing surface disposed opposite the spherical surface for slidable engagement with opposite surfaces of the annular plate 64 of the swash plate assembly.

As refrigerating enters a bore 14 through a section port 26, a piston 78 is forced toward the crankcase 38. Pressure in the crank chamber 39 forces the pistons 78 to slide toward the cylinder head 16, expelling refrigerating through the discharge ports 35 to the discharge chamber 22. Pressurized refrigerant exits the compressor 10 through the outlet port 24 to the remainder of the vehicular air condition circuit.

The cylinder block 12 and the suction valve 28 form a subassembly of the compressor 12. This subassembly can be used in other types of compressors.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A compressor for a vehicular air conditioning system comprising:

a cylinder block having a bore;

a piston slidingly received in the bore;

a cylinder head mounted on the cylinder block, the cylinder head including a suction chamber and a discharge chamber;

a valve plate provided between cylinder block and cylinder head, the valve plate including a suction port and a discharge port;

a suction valve cooperating with the suction port to permit refrigerant to enter the bore from the suction chamber, the suction valve including a terminating portion and a flexing portion; and a recess formed in the cylinder block adjacent the flexing portion of the suction valve, wherein the recess provides a linear clamping line on the suction valve between the valve plate and the cylinder block.

2. The compressor specified in claim 1 wherein the recess includes a linear wall spaced from a perimeter of the bore.

3. The compressor specified in claim 2 wherein the suction valve has a width and the liner wall has a length, wherein the length of the linear wall is greater than the width of the suction valve.

4. The compressor specified in claim 2 wherein the recess includes side walls perpendicular to the linear wall.

5. The compressor specified in claim 1 including a step formed in the cylinder block adjacent the terminating portion of the suction valve, wherein the recess is formed opposite the step.

6. The compressor specified in claim 5 wherein a depth of the recess is less than a depth of the step.

7. The compressor specified in claim 1 wherein the suction valve is a reed valve.

8. A cylinder block and suction valve subassembly for a compressor of a vehicular air condition system, the cylinder block and suction valve subassembly comprising:

a housing;

a bore formed in the housing;

a piston slidably received in the bore;

a suction valve provided over an end of the bore, the suction valve including a terminating portion and a flexing portion;

a step formed in the housing about a portion of the bore for receiving the terminating portion of the suction vale; and a recess formed in the housing about a portion of the bore providing a linear clamping line on the suction valve when it flexes into the step.

9. The subassembly specified in claim 8 wherein the recess includes a linear wall spaced from a perimeter of the bore.

10. The subassembly specified in claim 9 wherein the suction valve has a width and the liner wall has a length, wherein the length of the linear wall is at least equal to the width of the suction valve.

11. The subassembly specified in claim 10 wherein the recess includes side walls perpendicular to the linear wall.

12. The subassembly specified in claim 8 including a step formed in the cylinder block adjacent the terminating portion of the suction valve, wherein the recess is formed opposite the step.

13. The subassembly specified in claim 12 wherein a depth of the recess is less than a depth of the step.

14. The subassembly specified in claim 8 wherein the suction valve is a reed valve.

* * * * *

UNITED STATES PATENT AND TRADEMARK OFFICE

CERTIFICATE OF CORRECTION

PATENT NO. : 6,318,972 B1
DATED : November 20, 2001
INVENTOR(S) : Yong Huang et al.

It is certified that error appears in the above-identified patent and that said Letters Patent is hereby corrected as shown below:

Title page,
Item [75], change the first name of the second listed inventor from "Laviesh" to -- Lavlesh --.

After "Assistant Examiner—Leonid M Fastovsky" add
-- [74] *Attorney, Agent, of Firm*—Larry I. Shelton --.

Signed and Sealed this

Second Day of July, 2002

*Attest:*

*Attesting Officer*

JAMES E. ROGAN
*Director of the United States Patent and Trademark Office*